US005960518A

United States Patent [19]

Jeong

[11] Patent Number: 5,960,518

[45] Date of Patent: Oct. 5, 1999

[54] DOOR HINGE FIXING STRUCTURE FOR REFRIGERATOR

[75] Inventor: Gwan Sik Jeong, Changwon, Rep. of Korea

[73] Assignee: LG Electronics Inc., Rep. of Korea

[21] Appl. No.: 09/007,629

[22] Filed: Jan. 15, 1998

[30] Foreign Application Priority Data

Aug. 9, 1997 [KR] Rep. of Korea ..... 21806/1997
Aug. 9, 1997 [KR] Rep. of Korea ..... 21808/1997

[51] Int. Cl.[6] ..... E05D 7/12

[52] U.S. Cl. ..... 16/270; 16/257; 16/382; 49/388; 312/326; 312/405

[58] Field of Search ..... 16/270, 268, 267, 16/254, 258, 257, 262, 263, 382, DIG. 43; 248/284.1; 49/381, 397, 388; 312/326, 329, 405, 296, 401

[56] References Cited

U.S. PATENT DOCUMENTS

| | | | |
|---|---|---|---|
| 1,825,595 | 9/1931 | Kohl | 16/257 |
| 3,675,271 | 7/1972 | Fellwock et al. | 16/265 |
| 4,416,086 | 11/1983 | Niekrasz . | |
| 4,428,096 | 1/1984 | Kaspar . | |
| 4,610,489 | 9/1986 | Dibert, Jr. et al. | 16/262 |
| 5,579,606 | 12/1996 | Kim | 16/284 |

*Primary Examiner*—Chuck Y. Mah
*Attorney, Agent, or Firm*—Ostrolenk, Faber, Gerb & Soffen, LLP

[57] ABSTRACT

A door hinge fixing structure for a refrigerator which is capable of enabling an easier engagement and separation between a refrigerator main body and a door so that a door hinge structure is simply engaged to and separated from the refrigerator main body without using a predetermined device. The structure includes a support hinge fixed to the main body including a plurality of columns formed in one end portion of the support hinge, an upward fixing plate formed in another end portion of the support hinge and having an insertion hole, and spaced-apart fixing plates extended from both sides of the support hinge and each having a guide groove, an upper hinge engaged to the support hinge including a pin formed in an end portion of a lower surface of the upper hinge and inserted into a pin insertion hole formed in the refrigerator door, a support plate formed in another end portion of the upper hinge and inserted into an insertion hole of the fixing plate of the support hinge, and a column insertion hole into which the column of the support hinge is inserted, and a bar which is inserted along the guide groove of the fixing plate of the support hinge when engaging the upper hinge to the support hinge, and then closely contacts with the upper surface of the upper hinge and has a curved portion for fixing the upper hinge.

2 Claims, 4 Drawing Sheets

DOOR HINGE FIXING STRUCTURE FOR REFRIGERATOR

BACKGROUND OF THE INVENTION

1. Field of the Invention

The present invention relates to a door hinge fixing structure for a refrigerator, and in particular to an improved door hinge fixing structure for a refrigerator which is capable of enabling an easier engagement and separation between a refrigerator main body and a door so that a door hinge structure is simply engaged to and separated from the refrigerator main body without using a predetermined device.

2. Description of the Background Art Generally, as shown in FIG. 1, the conventional refrigerator includes a refrigerator main body 10 and a plurality of doors 20. When fabricating the refrigerator, the main body 10 and the doors 20 are individually fabricated. Thereafter, the main body 10 and the doors 20 are assembled. At this time, the doors 20 assembled to the main body so that the doors 20 are rotatable using door hinges 30.

The conventional door hinge fixing structure for a refrigerator which is rotatable between the main body 10 and the doors will be explained with reference to FIGS. 2 and 3.

First, in the hinge engaging structure of a lower portion of the refrigerator, a pin 40*a* inserted into a pin insertion hole 20*a* formed within a lower end portion of the door 20 is upwardly formed, and an engaging hole 40*b* is formed in a side portion of the main body 10 for being engaged into a lower hinge engaging hole 10*a* by a bolt 50.

In addition, in the hinge engaging structure of an upper portion of the refrigerator, a square-shaped support hinge 60 is fixed in an upper portion of the main body 10 of the refrigerator 10 and has a plurality of screw engaging holes 60*a*.

A predetermined-shaped upper hinge 70 has a plurality of screw engaging holes 70*b* engaged with the engaging holes 60*a* of the support hinge 60 and has a pin 70*a* inserted into a pin insertion hole 20*b* formed in an upper end portion of the door 20.

There are provided a plurality of screws 50 for engaging the upper hinge 70 and the support hinge 60 through the screw engaging holes 70*b* of the upper hinge 70 and the screw engaging holes 60*a* of the support hinge 60.

The upper hinges 70 and the support hinges 80 are provided in multiple in the upper portions of the main body 10.

The assembling of the conventional refrigerator door hinge fixing structure and the engaging process of the refrigerator main body 10 and the doors 20 will now be explained.

First, the engaging holes 40*b* formed in the lower hinge 40 are matched with the lower hinge engaging holes 10*a* formed in both lower end portions of the main body 10, and then the engaging holes 40*b* and the lower hinge engaging holes 10*a* are engaged using an engaging member such as a bolt 50, so that the lower hinge 40 is fixed to the lower portion of the refrigerator main body 10.

The pin 40*a* formed on an upper surface of the lower hinge 40 fixed to the lower portion of the main body 10 is inserted into the pin insertion hole 20*a* formed in the lower surface of the door 20, and the lower portion of the door 10 is engaged to the lower hinge 40.

The pin 70*a* formed in the lower surface of the upper hinge 70 is inserted into the pin insertion hole 20*b* formed in the upper surface of the door 20, and a plurality of screw engaging holes 70*b* formed on the upper surface of the upper hinge 70 are matched with the screw engaging holes 60*a* of the support hinges 60 formed to the upper surface of the refrigerator main body 10.

The upper hinge 70 is fixed to the refrigerator main body 10, and the door 20 and the refrigerator main body 10 are engaged using the screw engaging holes 70*b* of the upper hinge 70 and the screw engaging holes 60*a* of the support hinge 60 and the bolts 50.

In addition, when detaching the doors 20 from the refrigerator main body 10, the above-described engaging procedure is reversely performed.

However, in the above described conventional door hinge fixing structure for the refrigerator, the fabrication process is made complicated due to the use of tools and additional elements such as an engaging member for engaging and detaching the door and main body, and the fabrication time may be extended.

In addition, the engaging state of the screws may be loosened due to the abrasion of the screws by repeated engagement and separation between the door and the main body, so that the door may be deformed due to the loosened hinges.

SUMMARY OF THE INVENTION

Accordingly, it is an object of the present invention to provide a door hinge fixing structure for a refrigerator which overcomes the aforementioned problems encountered in the background art.

It is another object of the present invention to provide a door hinge fixing structure for a refrigerator which is capable of enabling an easier engagement and separation between a refrigerator main body and a door so that a door hinge structure is simply engaged to and separated from the refrigerator main body without using a predetermined device.

To achieve the above objects, there is provided a door hinge fixing structure for a refrigerator which includes a support hinge fixed to the main body including a plurality of columns formed in one end portion of the support hinge, an upward fixing plate formed in another end portion of the support hinge and having an insertion hole, and spaced-apart fixing plates extended from both sides of the support hinge and each having a guide groove, an upper hinge engaged to the support hinge including a pin formed in an end portion of a lower surface of the upper hinge and inserted into a pin insertion hole formed in the refrigerator door, a support plate formed in another end portion of the upper hinge and inserted into an insertion hole of the fixing plate of the support hinge, and a column insertion hole into which the column of the support hinge is inserted, and a bar which is inserted along the guide groove of the fixing plate of the support hinge when engaging the upper hinge to the support hinge, and then closely contacts with the upper surface of the upper hinge and has a curved portion for fixing the upper hinge.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The door hinge fixing structure for a refrigerator according to the present invention will now be explained with reference to the accompanying drawings.

First, in the door hinge fixing structure according to the present invention, when assembling a refrigerator main body 100 and a door 500, since the engaging and disassembling operation between the refrigerator main body 100 and the hinge fixing structure installed in the lower portion of the door 500 is similar with the conventional art, the description thereof will be omitted.

Figure 1:
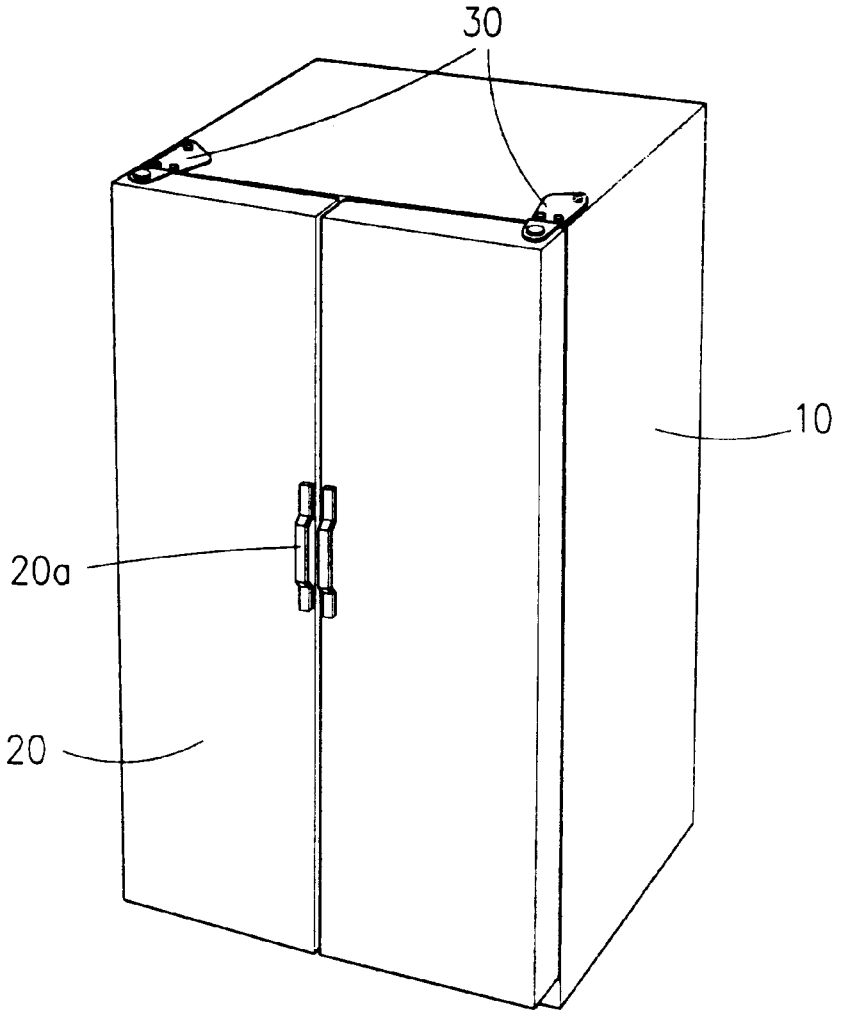
FIG. 1 CONVENTIONAL ART
FIG. 1 is a perspective view illustrating a conventional door hinge fixing structure engaged between a refrigerant main body and door.
Figure 2:
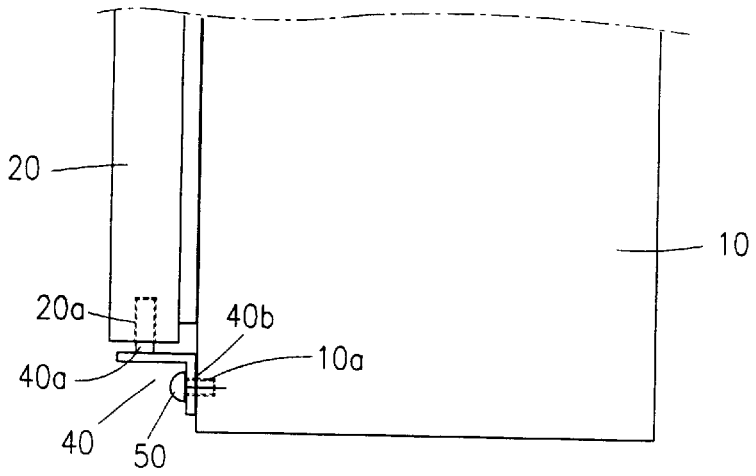
FIG. 2 CONVENTIONAL ART
FIG. 2 is a side view illustrating an engaging state between a lower portion of the refrigerator and a low portion of the door which are engaged by a lower hinge in the conventional art.
Figure 3:
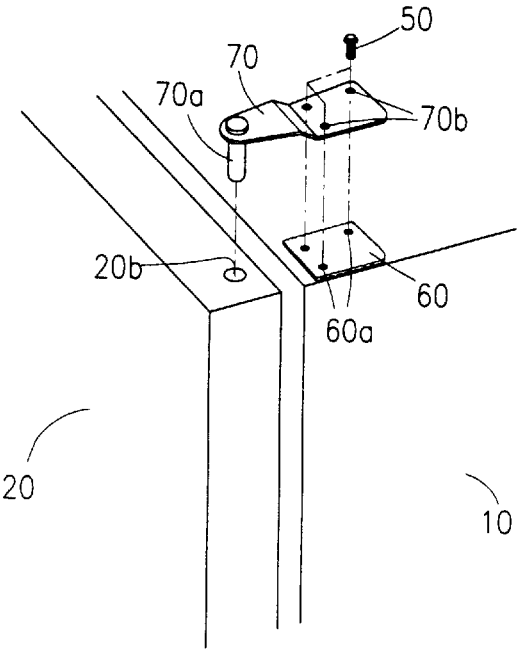
FIG. 3 CONVENTIONAL ART
FIG. 3 is an exploded perspective view illustrating a conventional door hinge fixing structucture.
Figure 4:
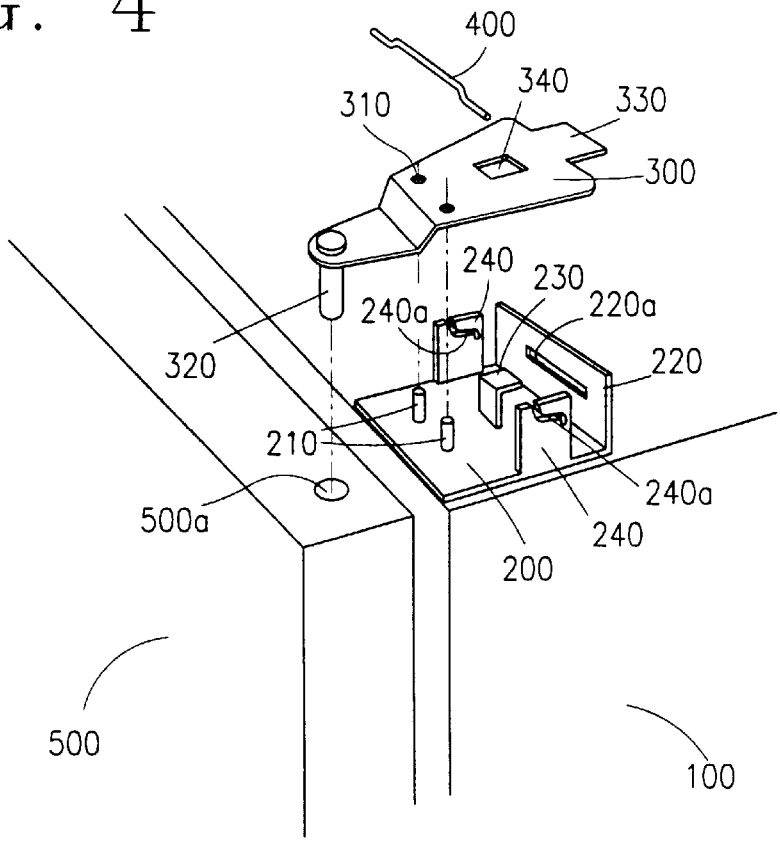
FIG. 4 is an exploded perspective view illustrating a door hinge fixing structure according to a first embodiment of the present invention.
Figure 5:
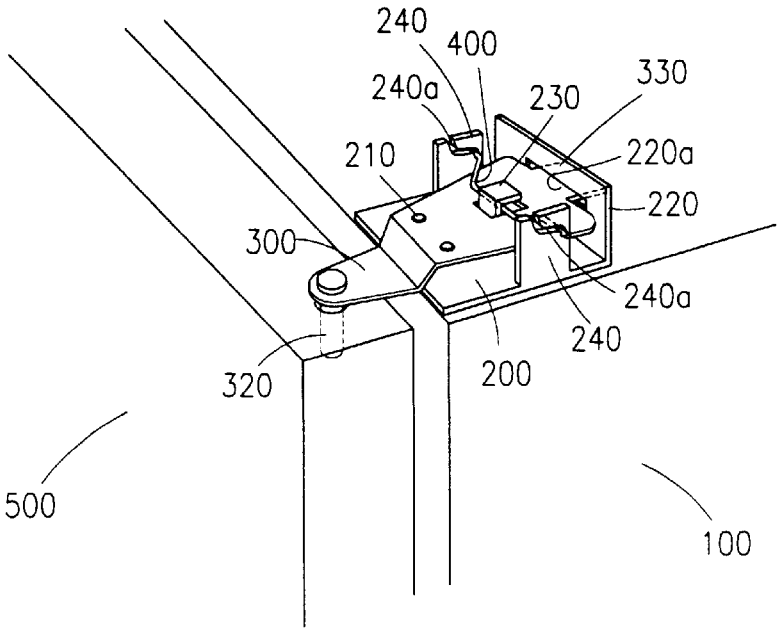
FIG. 5 is a perspective view illustrating an engaging state of a door hinge fixing structure according to the present invention.

The door hinge fixing structure according to the present invention is directed to a hinge fixing structure between the upper portion of the refrigerator main body 100 and the upper portion of the door 500. As shown in FIGS. 4 and 5, in one embodiment of the present invention, a support hinge 200 is fixed in one side of the refrigerator main body 100, and an upper hinge 300 is assembled to the upper portion of the support hinge 200.

In addition, there is provided a bar 400 for fixing the upper hinge 300 assembled to the upper portion of the support hinge 200.

Both ends of the bar 400 are curved.

The support hinge 200 and the upper hinge 300 assembled to the upper portion of the support hinge 200 will now be explained in more detail.

First, the support hinge 200 is square-shaped and has a plurality of columns 210 formed in one side thereof. In addition, an upright fixing plate 220 is integrally extended from one side of the support hinge 200 and has a horizontally elongated insertion hole 220*a*.

In addition, an engaging plate 230 is formed on the support hinge 200 and has a curved portion for fixing the bar 400, and spaced-apart fixing plates 240 are integrally extended from both sides of the support hinge 200 and each have a guide groove 240*a* to which the bars 400 are engaged.

The triangle-shaped upper hinge 300 includes a plurality of column insertion holes 310 into which the columns 210 of the support hinge 200 are inserted.

A pin 320 is formed in one end portion of the upper hinge 300 and inserted into a pin insertion hole 500*a* formed in the door 500, and a support plate 330 is extended from the other end portion of the same so that the support plate 330 is inserted into the insertion hole 220*a* formed in the fixing plate 220 of the support hinge 200.

An engaging plate insertion hole 340, into which the engaging plate 230 of the support hinge 200 is inserted, is formed in the center portion of the upper surface on which the column insertion holes 310 and the support plate 330 are formed.

The engaging procedure of the door hinge structure according to the present invention will now be explained with reference to the accompanying drawings.

First, the refrigerator main body 100 and the lower portion of the door 500 are assembled by the lower hinge (not shown). In the refrigerator main body 100 and the hinge fixing structure of the upper portion of the door 500, the support hinge 200 is fixed to the upper surface of the refrigerator main body 100 by a welding method, an adhesive, or the like. Thereafter, the support plate 330 of the upper hinge 300 is inserted into the insertion hole 220*a* formed in the fixing plate 220 of the support hinge 200, and the engaging plate 230 and the columns 210 of the support hinge 200 are inserted into the engaging plate insertion hole 340 and the column insertion holes 310 formed in the upper hinge, respectively.

Therefore, the upper hinge 300 engaged to the columns 210 of the support hinge 200 is stably fixed, thus preventing the movements thereof.

The bar 400 is engaged to the support hinge 200 and the upper hinge 300 along the guide groove 240*a* formed in the fixing plate 240 of the support hinge 200. Thereafter, both ends extended from the bar 400 is rotated in the clockwise direction, so that the center portion of the bar 400 is engaged with the engaging plate 230 of the support hinge 200.

When the bar 400 is fixed in the above-described manner, the upper hinge 300 being pressed by the bar 400 closely contacts with the support hinge 200, thus preventing the movements thereof.

The disassembling procedure is opposite the above-described assembling procedure. Namely, the bar 400 pressing the upper hinge 300 is separated from the guide groove 240*a* of the fixing shaft 240 of the support hinge 200, and then the upper hinge 300 is upwardly lifted, so that the columns 210 and the engaging plate 230 are escaped from the column insertion holes 310 and the engaging plate insertion hole 340. The support plate 330 of the upper hinge 300 is escaped from the insertion hole 220*a* of the fixing plate 220 of the support hinge 200, thus separating the upper hinge 300.

The door hinge fixing structure for a refrigerator according to another embodiment of the present invention will be explained with reference to the accompanying drawings.

First, since the lower hinge structure of the door hinge fixing structure for a refrigerator according to another embodiment of the present invention is similar with the conventional structure, the description thereof will be omitted.

Figure 6:
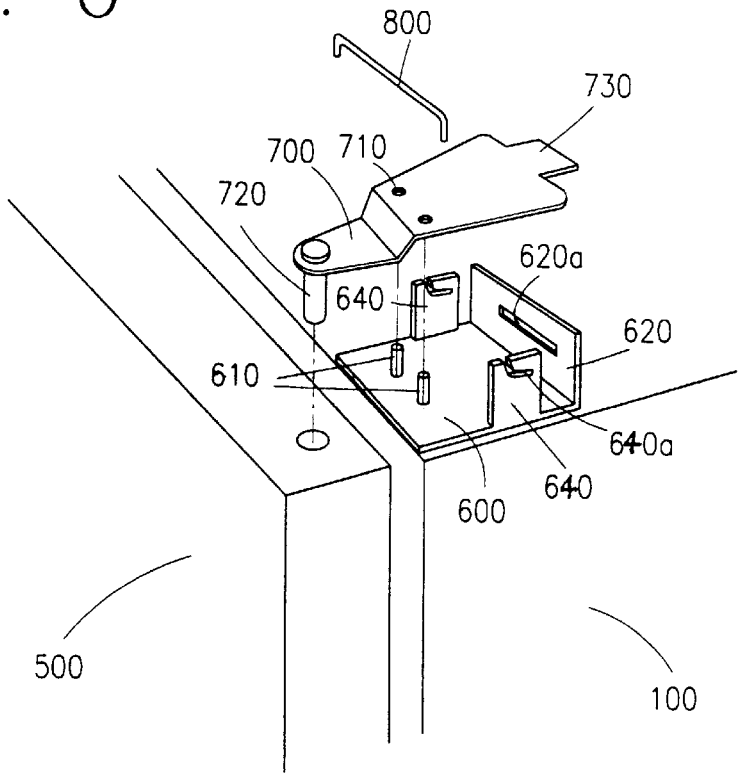
FIG. 6 is an exploded perspective view illustrating a door hinge fixing structure according to another embodiment of the present invention.
Figure 7:
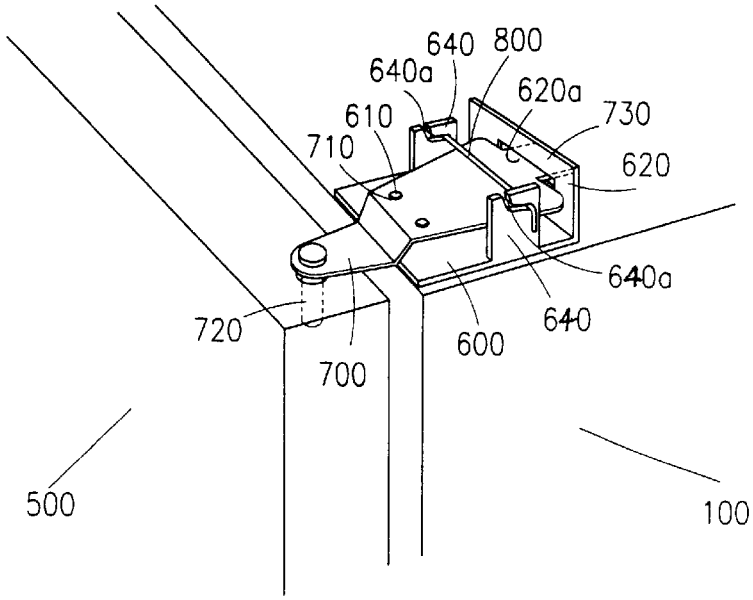
FIG. 7 is an exploded perspective view illustrating a door hinge fixing structure according to another embodiment of the present invention.

As shown in FIGS. 6 and 7, the door hinge fixing structure for a refrigerator according to another embodiment of the present invention includes a support hinge 600 fixed at both sides of a refrigerator main body 100, and an upper hinge 700 assembled to an upper portion of the support hinge 600.

In addition, a bar 800, the both ends of which are curved, is engaged to the upper portion of the support hinge 600 for fixing the upper hinge 700.

The support hinge 600 and the upper hinge 700 engaged to the upper portion of the support hinge 600 will be explained in more detail.

First, the support hinge 600 is square-shaped, and a plurality of upward columns 610 are formed in an end portion of the same, and a fixing plate 620 is formed in another end portion of the same and has an upwardly curved portion and an insertion hole 620*a*.

In addition, a fixing plate 640 is formed in both sides of the upper surface on which the columns 610 and the fixing plate 620 are formed and has an L-shaped guide groove 640*a* to which the bar 800 is engaged.

The upper hinge 700 is triangle-shaped and includes a plurality of column insertion holes 710 into which the columns 610 of the support hinge 600 are inserted.

A pin 720 is formed in one end portion of the upper hinge 700 and is inserted into a pin insertion hole 500*a* of the door 500, and a fixing plate 730 is formed in another end portion of the upper hinge 700 so that the fixing plate 730 is inserted into an insertion hole 620*a* formed in the fixing plate 620 of the support hinge 600.

The engaging procedure of the door hinge fixing structure according to another embodiment of the present invention will now be explained with reference to the accompanying drawings.

First, since the lower hinge engaging procedure of the door hinge fixing structure according to another embodiment of the present invention is similar with the conventional art, the description thereof will be omitted.

Therefore, in the door hinge fixing structure for a refrigerator according to another embodiment of the present invention, the support hinge 600 is fixed to the upper surface of the refrigerator main body 100 by a welding method, an adhesive, or the like. Thereafter, the fixing plate 730 of the upper hinge 700 is inserted into the insertion hole 620*a* formed in the fixing plate 620 of the support hinge 600, and the columns 610 of the support hinge 600 are inserted into the column insertion holes 710 formed in the upper hinge 700.

The upper hinge 700 engaged with the columns 610 of the support hinge 600 is prevented from being moved in a predetermined direction.

The bar 800 is engaged by inserting along the guide groove 640*a* formed in the fixing plate 640 of the support hinge 600 in the upper portion of the upper hinge 700 engaged to the upper portion of the support hinge 600, so that the upper hinge 700 closely contacts with the support hinge 600, thus preventing the movements of the upper hinge 700, and thus the upper hinge 700 is stably fixed.

When disassembling the door hinge fixing structure according to the present invention, the procedure is performed opposedly from the above-described assembling procedure. Namely, the bar 800 supporting the upper hinge 700 is separated from the guide groove 640*a* of the fixing plate 640 of the support hinge 600, and then the upper hinge 300 is upwardly lifted, thus separating the same from the columns 210 of the support hinge 600. Therefore, the fixing plate 730 of the upper hinge 700 is separated from the insertion hole 620*a* of the fixing plate 620 of the support hinge 600, thus separating the upper hinge 700.

As described above, in the door hinge fixing structure for a refrigerator according to the present invention, the refrigerator main body and the door are easily engaged and disassembled without using a predetermined device (tool) for assembling and disassembling the same, thus enhancing the productivity of the refrigerator and reducing the fabrication cost.

Although the preferred embodiment of the present invention have been disclosed for illustrative purposes, those skilled in the art will appreciate that various modifications, additions and substitutions are possible, without departing from the scope and spirit of the invention as recited in the accompanying claims.

What is claimed is:

1. A door hinge fixing structure for a refrigerator having a refrigerator main body and a door having a pin insertion hole, the door hinge comprising:

a support hinge structured for being fixed to the main body of the refrigerator, the support hinge including:

a plurality of columns formed in one end portion of the support hinge;

an upward fixing plate formed in another end portion of the support hinge and an insertion hole formed on the upward fixing plate;

a respective spaced-apart fixing plate extending from each of both sides of the support hinge; and a guide groove formed in each of the spaced-apart fixing plates;

an upper hinge engaged to the support hinge and including:

a pin formed in an end portion of a lower surface of the upper hinge and adapted to be inserted into a pin insertion hole formed in the door of the refrigerator;

a support plate formed in another end portion of the upper hinge and inserted into the insertion hole of the upward fixing plate of the support hinge; and a plurality of column insertion holes into which the columns of the support hinge are inserted; and a bar which is bent at its ends and inserted along the guide groove of the spaced-apart fixing plates of the support hinge for fixing the upper hinge when engaging the upper hinge to the support hinge.

2. A door hinge fixing structure for a refrigerator, comprising:

a support hinge adapted to be fixed to a main body of the refrigerator and including:

a plurality of columns formed in one end portion of the support hinge;

an upward fixing plate formed in another end portion of the support hinge and an insertion hole being formed on the upward fixing plate;

a respective spaced-apart fixing plate extending from each of both sides of the support hinge and a guide groove formed in each of the spaced-apart fixing plates; and an engaging plate formed in an upper center portion of the support hinge, wherein an upper portion of the engaging plate is curved;

an upper hinge engaged to the support hinge and including:

a pin formed in an end portion of a lower surface of the upper hinge and adapted to be inserted into a pin insertion hole formed in a door of the refrigerator;

a support plate formed in another end portion of the upper hinge and inserted into the insertion hole of the upward fixing plate of the support hinge;

an engaging plate insertion hole formed in a center portion of the upper hinge and into which the engaging plate of the support hinge is inserted; and a plurality of column insertion holes into which the columns of the support hinge are inserted; and a bar which is offset at its ends and inserted along the guide grooves of the spaced-apart fixing plates of the support hinge and engaged with the engaging plate of the support hinge for fixing the upper hinge when engaging the upper hinge to the support hinge.

* * * * *